United States Patent [19]

Reist

[11] Patent Number: 4,895,360

[45] Date of Patent: Jan. 23, 1990

[54] METHOD AND APPARATUS FOR PROCESSING PRODUCTS ARRIVING IN AN IMBRICATED FORMATION, ESPECIALLY PRINTED PRODUCTS

[75] Inventor: Walter Reist, Hinwil, Switzerland

[73] Assignee: Ferag AG, Hinwil, Switzerland

[21] Appl. No.: 219,202

[22] Filed: Jul. 15, 1988

[30] Foreign Application Priority Data

Jul. 21, 1987 [CH] Switzerland ..... 02754/87

[51] Int. Cl.[4] ..... B65H 29/04; B65H 29/66

[52] U.S. Cl. ..... 271/202; 271/204

[58] Field of Search ..... 271/277, 204, 206, 202, 271/203, 270

[56] References Cited

U.S. PATENT DOCUMENTS

| | | | |
|---|---|---|---|
| 2,610,850 | 9/1952 | Huck | 271/203 |
| 2,769,634 | 11/1956 | Koch | 271/203 |
| 4,132,403 | 1/1979 | Weisbach | 271/277 |
| 4,201,286 | 5/1980 | Meier | 271/202 X |
| 4,320,894 | 3/1982 | Reist | 271/277 |

FOREIGN PATENT DOCUMENTS

| | | | |
|---|---|---|---|
| 3306815 | 10/1983 | Fed. Rep. of Germany . | |
| 101546 | 8/1980 | Japan | 271/202 |
| 966402 | 8/1964 | United Kingdom . | |

*Primary Examiner*—Richard A. Schacher

*Attorney, Agent, or Firm*—Bell, Seltzer, Park and Gibson

[57] ABSTRACT

At a conveyor device following an infeed conveyor, individually controllable grippers are arranged in spaced relationship at a revolvingly driven buffer chain. These grippers serve to engage folded printed products at their leading edges and which are infed in imbricated formation. The links of the buffer chain are interconnected by pivot bolts. These pivot bolts are alternately displaceably mounted in guide members. By reducing the spacing between these guide members, there is increased the spacing between the grippers. By increasing the spacing between the guide members it is possible to again reduce the spacing between the grippers. At a product take-over region the printed products are engaged by the grippers. At a subsequently arranged product acceleration region the spacing between the grippers is enlarged so that the printed products, in this acceleration region, no longer are in overlapping formation. At a product singling region a drag drive acts upon the links of the buffer chain. In a subsequently arranged product deceleration region the spacing between the grippers is again reduced and the printed products are placed into a suspended position. In subsequent product transfer region, the printed products are delivered to an outfeed conveyor.

18 Claims, 9 Drawing Sheets

METHOD AND APPARATUS FOR PROCESSING PRODUCTS ARRIVING IN AN IMBRICATED FORMATION, ESPECIALLY PRINTED PRODUCTS

CROSS-REFERENCE TO RELATED APPLICATION

This application is related to the commonly assigned, copending U.S. patent application Ser. No. 07/219,206 filed July 15, 1988 and entitled "TRANSPORT APPARATUS FOR FLAT PRODUCTS, ESPECIALLY PRINTED PRODUCTS" to which reference may be readily had and the disclosure of which is incorporated herein by reference.

BACKGROUND OF THE INVENTION

The present invention relates to a new and improved method of, and apparatus for, processing substantially flat or superficial products, especially printed products.

In its more particular aspects, the present invention concerns a method for processing substantially flat or superficial products, especially folded printed products which arrive in an imbricated or shingled formation or array, each product bearing upon the next following or trailing product, and wherein overlapping or shingled products are separated from one another.

As noted previously, there is also provided an apparatus for processing substantially flat or superficial products, especially folded printed products, which is of the type comprising an infeed device for the infeed or delivery of the products in an imbricated or shingled formation or array, wherein each product bears or lies upon the next following or trailing product. There is also provided an arrangement for separating or singling the overlapping products.

In the case of imbricated or shingled product formations, in which each product lies or bears upon the next following or trailing product, the problem exists that the leading region or portion of each product is covered by the preceding or immediately leading product. The leading region of the products is therefore not freely accessible in order that it can be acted upon or manipulated. In European Published Patent Application No. 136,498 and the corresponding U.S. Pat. No. 4,595,192, granted June 17, 1986, there are disclosed a method and apparatus by means of which printed products in an imbricated or shingled formation or array of the type described above can be re-imbricated or re-positioned such that in the outfed imbricated or shingled product formation each printed product bears upon the preceding or next leading printed product. The printed products of the arriving imbricated formation are separated or singled from one another by acceleration devices and are formed into a new imbricated formation.

In the new imbricated formation of printed products, the leading region of each printed product is freely accessible and can be engaged from above. What is disadvantageous in this arrangement is that the printed products, during acceleration thereof, can be uncontrollably moved out of the imbricated assembly or composite structure, in other words, can be undesirably singled. As a result, the product relationship between neighboring printed products becomes lost.

Additionally, upon arrival at the acceleration device, each printed product is suddenly or abruptly withdrawn from the following or trailing printed products and such motion also can cause entrainment of the following or trailing printed products and, in turn, undesired positional shifting thereof. Therefore, with such prior art equipment and processing procedure it is not possible to guarantee that in the newly formed imbricated formation the positional relationship between the printed products will still be the same. If that undesirable situation arises then the imbricated product formation or array is no longer under positive control for performing further operations or manipulations.

SUMMARY OF THE INVENTION

Therefore with the foregoing in mind it is a primary object of the present invention to provide a new and improved method of, and apparatus for, separating or singling products arriving in an imbricated or shingled formation or array, especially printed products, in a manner which does not suffer from the aforementioned drawbacks and shortcomings of the prior art constructions.

Another and more specific object of the present invention aims at the provision of a new and improved method of, and apparatus for, maintaining at all times under control a desired mutual position of the products in the imbricated formation.

Yet a further significant object of the present invention is directed to the provision of a new and improved method of, and apparatus for, separating or singling imbricated products, especially printed products, in a manner such that the positional relationship of the products with respect to one another in the imbricated formation is positively ensured for and controlled, so that further processing of the printed products can be carried out in an extremely reliable and efficient fashion.

An additional noteworthy object of the present invention aims at the provision of a new and improved construction of an apparatus for separating products arriving in imbricated formation, especially printed products, which apparatus is relatively simple in construction and design, exceedingly reliable in operation, not readily subject to breakdown and malfunction, and requires a relatively modest amount of servicing and maintenance.

Now in order to implement these and still further objects of the invention which will become more readily apparent as the description proceeds, the method for processing substantially flat or superficial products, especially folded printed products, comprises individually engaging or seizing the products at their leading region or portion by grippers moved along a conveying path and arranged in succession or tandem in a predetermined direction of movement or conveyance of the products. Thereafter, the spacing or distance between each two successive grippers is increased to such an extent that each product is brought into non-overlapping relationship with respect to the next following or trailing product.

As alluded to above, the invention is not only concerned with the aforementioned product processing method but also deals with an apparatus for processing substantially flat or superficial products, especially folded printed products. According to important aspects of the apparatus, the arrangement for separating or singling the overlapping products comprises a conveyor device arranged following the infeed device as viewed with respect to a predetermined direction of movement or conveyance of the printed products. The conveyor device comprises individually controllable grippers or gripper elements mounted in spaced relationship from one another at at least one revolvingly driven traction element. These individually controllable grippers or gripper elements serve for engaging in each case one of the infed products at the leading region or portion thereof. Additionally, there are provided means for increasing the spacing between successive grippers after the grippers have engaged the printed products.

Since the printed products are individually engaged by the grippers or gripper elements at their leading region or portion and then thereafter the spacing between two tandem or successively arranged grippers is enlarged, the printed products are forced to assume a position governed or dictated by the grippers or gripper elements. Hence, the printed products are always under control. Since the spacing between the grippers or gripper elements is continuously or continually increased the printed products are subject to modest accelerations. Since the printed products are retained by the grippers or gripper elements, it is beneficially possible to outfeed the printed products in any desired or random direction. This also leads to the advantageous result that the arriving imbricated formation of products can be processed at greater velocity or speed.

Since after the successive products have been separated from one another, the spacing between the grippers or gripper elements is again reduced, the transfer of the printed products to the outfeed or delivery conveyor can be accomplished without any problem at a reduced product spacing. If the products or printed products are brought into a suspended position, then they can be engaged from above by suitable gripper or clamp elements, such as gripper or clamp fingers of the outfeed or delivery conveyor.

Preferably the traction element comprises a revolving buffer chain or chain means having hingedly interconnected links or brackets. If the hinge elements, such as the hinge or pivot bolts of the links are mounted in alternation at first and second guides or guide members, then by changing the spacing of these guide members in a direction substantially perpendicular to the hinge or pivot bolts and to the predeterminate conveyance or conveying direction of the products, it is possible to alter the spacing of the grippers or gripper elements attached to the buffer chain. If there is increased the spacing between the first and second guides or guide members then there is reduced the spacing between the grippers. On the other hand, if the spacing between these guides or guide members is reduced then there is increased the mutual spacing between the grippers.

Preferably, the grippers or gripper elements are arranged upon bearing or pillow blocks or equivalent structure which are mounted at first guides of the guides or guide members. In this case, the bearing blocks or the like are advantageously operatively connected with the buffer chain by a respective hinge or pivot element, such as a hinge or pivot bolt. A mounting of the links or brackets neighboring the bearing block at the first guide or guide member is no longer necessary.

In a particularly preferred arrangement, at the singling or separation region, where the successive grippers exhibit the greatest mutual spacing from one another, there is effective a drag or tow drive upon the links or brackets. The enlargement and subsequent reduction of the mutual spacing between the grippers or gripper elements is thus rendered possible in a very simple fashion.

The grippers or gripper elements are preferably pivotably mounted at the bearing blocks for pivotal motion about an associated axis which is substantially parallel to the hinge bolts. The grippers can be pivoted or rocked by means of cams or equivalent structure, so that the products or printed products can be brought into the proper position for transfer to the outfeed or delivery conveyor or the like. During such time as the grippers or gripper elements are not guided in the cams they are retained in their rest position by resilient or spring elements.

Two traction elements which revolve in synchronism, are preferably arranged in mutually parallel and spaced relationship or arrangement with respect to one another. The products or printed products thus can be engaged or seized at their leading region or portion at both lateral ends and further processed, thus preventing any kinking or undesired bending or buckling of the printed products.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
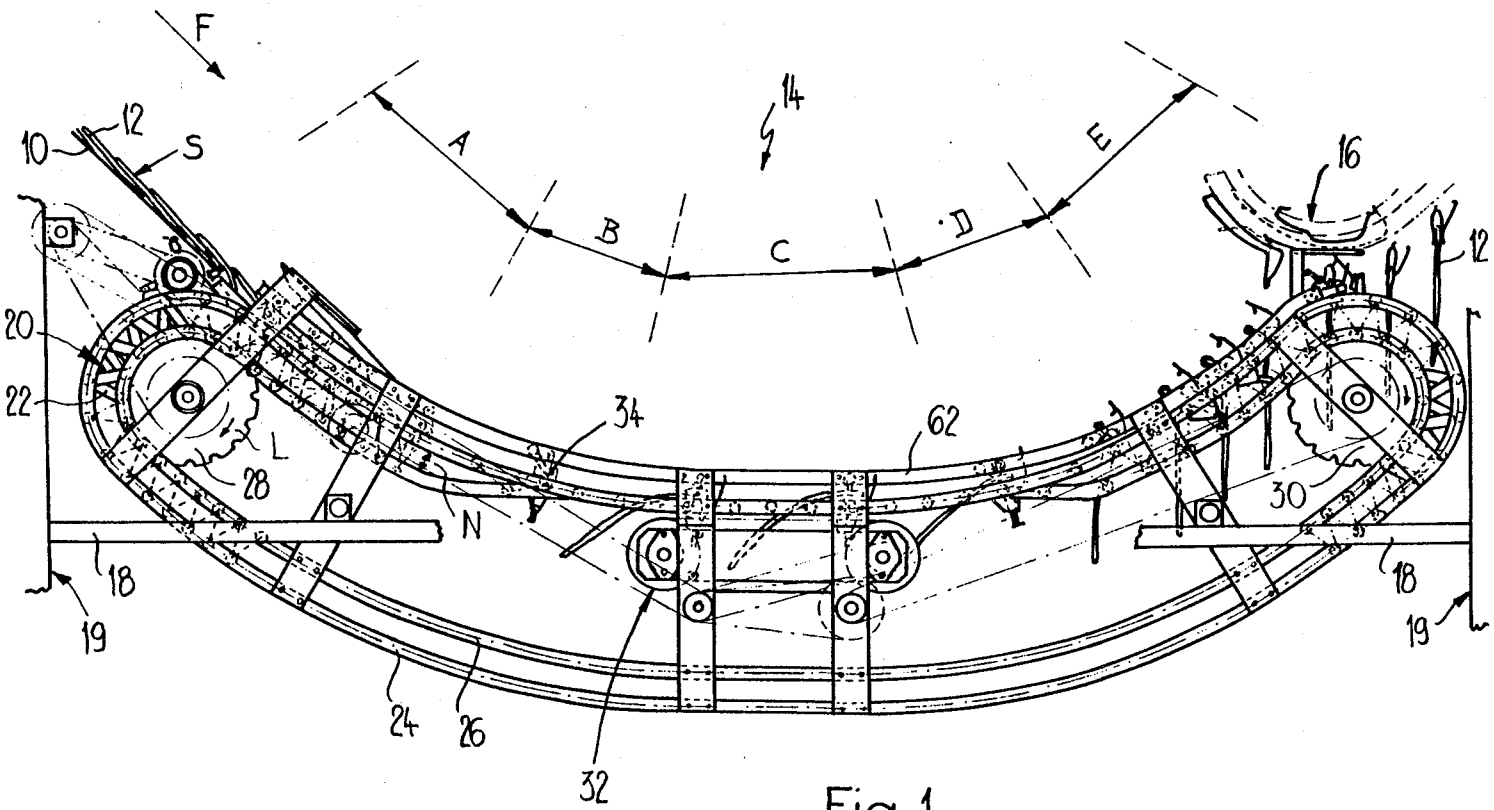
FIG. 1 is a side view depicting the main portion of an apparatus for processing folded printed products, portraying a partially illustrated infeed device, an arrangement for separating or singling overlapping printed products and a partially illustrated outfeed or delivery conveyor for the printed products.

Describing now the drawings, it is to be understood that to simplify the showing thereof, only enough of the apparatus for processing flat products, especially printed products, has been illustrated therein as is needed to enable one skilled in the art to readily understand the underlying principles and concepts of this invention. Turning now specifically to FIG. 1, there will be recognized a product infeed device 10, such as an infeed conveyor, which has only been schematically depicted. This infeed device 10 conveys folded products, here printed products 12, such as for instance, newspapers, periodicals, magazines or component parts or inserts thereof. These printed products 12 are arranged in a reposing fashion in imbricated or shingled formation or array S and are delivered in such imbricated formation or array S to a conveyor or transport device or arrangement 14. The conveyor device or arrangement 14 advantageously comprises two substantially parallel arranged ones of such conveyor devices 14, only one of which has been depicted in FIG. 1, although two such conveyor devices or structures 14 have been shown in FIG. 5. This conveyor device or arrangement 14 has disposed thereafter, as viewed in a predeterminate direction of travel or conveying or conveyance direction of the printed products 12, an outfeed outfeed or delivery conveyor 16 takes over or receives from the conveyor device 14 the printed products 12 which have been placed into a mutually separated and suspended posture and outfeeds the thus received printed products 12.

For the foregoing reasons, it should suffice to consider in the following description the conveyor device or structure 14 located at one side region of the processing apparatus.

The conveyor device 14 is secured to struts or support members 18 of a frame or frame unit 19 which has only partially illustrated. The traction element of the conveyor device or arrangement 14 comprises a buffer chain 20 having hingedly interconnected links or brackets or straps 22 or the like. Each such buffer chain 20 is revolvingly driven by means of an associated drag or tow drive or drive means 32 in endless or closed first and second guides or guide member 24 and 26 by means of the drive wheels 28 and 30. Viewed in the direction of movement of the buffer chain 20 there are arranged at such buffer chain 20 grippers or gripper elements 34 which are disposed in tandem or succession with respect to one another. To improve clarity of illustration, only individual grippers or gripper elements 34 have been depicted in FIG. 1. Also it is to be observed that reference characters A, B, C, D and E designate five partial regions or zones of the conveyor device or arrangement 14. These reference characters have the following significance:

A designates a product take-over region or zone,

B designates a product acceleration region or zone,

C designates a product separation or singling region or zone,

D designates a product deceleration region or zone, and

E designates a product transfer region or zone.

It will be understood that during the description of the further figures of the drawings as given hereinafter, there will be frequently made reference to these regions or zones. Viewed in the conveying or conveyance direction F, for instance as related to the infed printed products 12, the guides or guide members 24 and 26 at the take-over region or zone A extend at an inclination downwardly, at the separation or singling region or zone C they extend substantially horizontally and in the transfer region or zone E they extend at an inclination upwardly.

Figure 2:
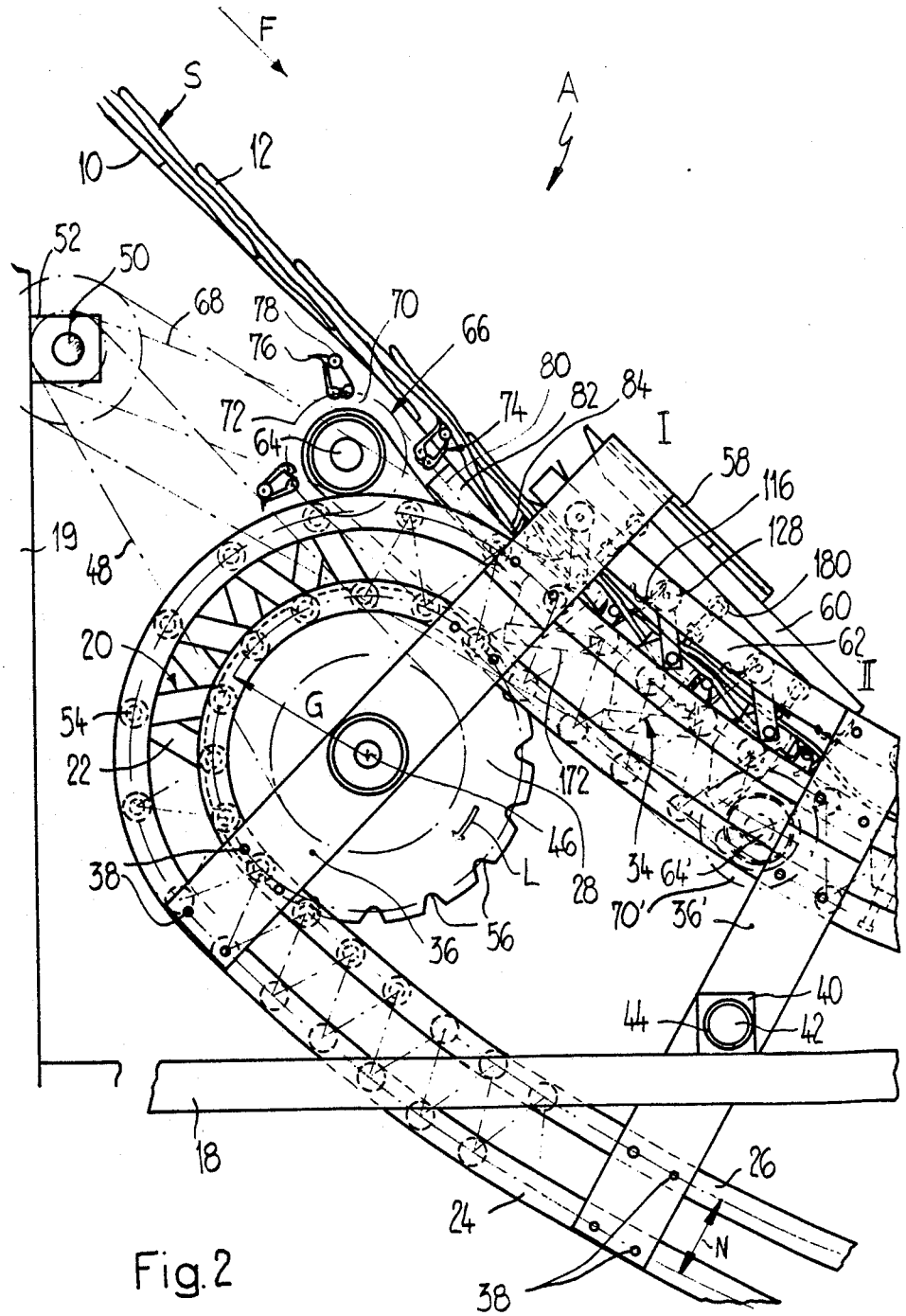
FIG. 2 is an enlarged view in relation to the illustration of FIG. 1, depicting the product take-over region of the separation arrangement where the printed products are taken over or received by the separation arrangement from the infeed device.

FIG. 2 illustrates on an enlarged scale and in side view the product take-over region A of the conveyor device or arrangement 14 which has been depicted in FIG. 1. The first and second guides 24 and 26 are secured at the support elements 36 and 36', respectively, by means of the threaded bolts 38 or equivalent fastening expedients. At the struts or strut members 18 there is connected, as by welding, a bearing flange or flange member 40 in which there is mounted a bolt or bolt member 42 arranged at the support element 36'. Between the bearing flange 40 and the bolt or bolt member 42, there is arranged a damping element 44. At the support element 36, there is rotatably mounted a drive shaft or shaft member 46 of the drive wheel 28. This drive shaft or shaft member 46 is operatively connected by means of a chain drive 48, depicted in chain-dot or phantom lines, with a power take-off shaft 50 of a not particularly illustrated but suitable drive motor. The power take-off shaft 50 is rotatably mounted at a further bearing flange or flange member 52 of the frame or frame unit 19.

The links or brackets or straps 22 of the buffer chain 20 are pivotably connected with one another by means of hinge or pivot elements, here shown as hinge or pivot bolts 54. These pivot bolts 54 are alternately displaceably mounted in the first and second guides or guide members 24 and 26. Reference numeral N designates the spacing of these guides or guide members 24 and 26 in a direction essentially perpendicular to the pivot or hinge bolts 54 and the conveying direction F. The guides or guide members 24 and 26 concentrically enclose the drive wheel 28 through an angle of approximately 180° and at the circumference of the drive wheel or wheel member 28 there are arranged at the same spacing from one another radial entrainment cut-outs or recesses 56. Since an average or mean radius G of the drive wheel 28 is of the same size as the average or mean spacing between the drive shaft 46 and the hinge bolts 54 guided in the second guide or guide member 26 at the region of the drive wheel 28, these entrainment cut-outs or recesses 56 come into engagement with the hinge or pivot bolts 54. As will be explained more fully hereinafter, the buffer chain 20 is constructed such that the shortest or minimum spacing of two neighboring pivot or hinge bolts 54, which are mounted in the second guide or guide member 26, is of the same magnitude as the spacing or distance between two entrainment cut-outs or recesses 56.

The grippers or gripper elements 34 are operatively connected with their associated buffer chain 20. It will also be observed that for clarity of illustration of the structure depicted in FIG. 2 only three grippers or gripper elements 34 have been depicted. At the upper end of the support element 36 there is arranged a cam carrier or support member 58 at which there is secured a gripper closure or closing cam or cam member 60. At the support elements 36 and 36', there is likewise attached a rotation cam or cam member 62. At the not particularly illustrated revolving cam system carrier or support there are rotatably mounted two bearing shafts or shaft members 64 and 64' of a revolving cam system or cam means 66. The bearing shaft 64 is operatively connected by a further chain drive 68 with the power take-off shaft or shaft member 50. This further chain drive 68 has been illustrated in FIG. 2 with chain-dot or phantom lines. At the bearing shafts 64 and 64' there are arranged the guide wheels or wheel members 70 and 70', respectively, about which there is trained a conveyor element, here an endless chain or chain member 72 which has been shown in chain-dot or phantom lines. This endless chain or chain member 72 is provided with cams or cam members or dogs 74 or equivalent structure arranged in succession in the direction of revolving motion of the endless chains 72. The spacing of two successive cams or cam members 74 from one another is exactly of the same magnitude as the spacing of two grippers or gripper elements 34 at the take-over region or zone A.

A free end 76 of each cam or cam member 74, and which protrudes from the endless chain 72, is rearwardly the endless chain 72. At the leading free end of each cam or cam member 74 there is rotatably mounted an entrainment roll or roller 78. The entrainment roll 78 preferably is formed of a suitable plastics material. The endless chain 72 is guided at the region of its conveying-active run 80 in a chain guide or guide member 82. The revolving cam system 66 is arranged beneath the imbricated formation or stream S of the printed products 12 at the take-over region or zone A so that the cams 74, during their rotation about the guide wheel or wheel member 70, come to bear, initially by means of the entrainment roll or roller 78 and then also with the free end 76, from below against the printed products 12. Thus, the printed products 12 are raised by the cams 74 at their central or intermediate region, whereas a front edge 84 of each printed product 12 comes to bear at the rear end of the preceding or leading cam or cam member or dog 74. The revolving cam or dog system 66 acts upon the printed products 12 as an alignment device, as such will be described more fully hereinafter.

Figure 3:
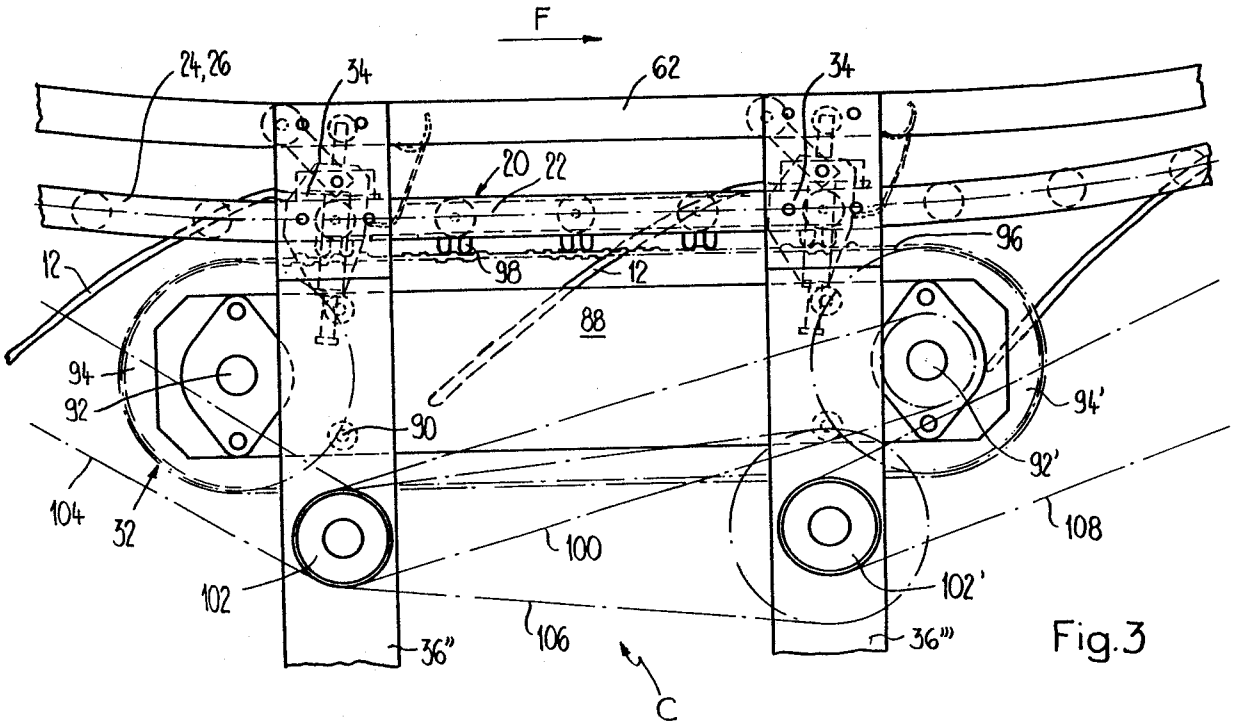
FIG. 3 illustrates on an enlarged scale, like the showing of FIG. 2, the singling region of the separation arrangement of the processing apparatus depicted in FIG. 1.

FIG. 3 shows on an enlarged scale the product separating or singling region or zone C. At the support elements 36'' and 36''', which are appropriately secured in any suitable fashion at the struts or strut members 18, there is arranged the drag or tow drive or drive means 32. A drag drive support plate 88 is connected by threaded bolts 90 or equivalent fastening expedients with the support elements 36'' and 36'''. Rotary bolts 92 and 92' are rotatably mounted at the drag drive support plate 88. At each rotary bolt or bolt member 92 and 92' there is arranged a deflection wheel or wheel member 94 and 94', respectively. An endless revolving drag or tow band or belt 96 or equivalent drag structure is trained or guided about the deflection wheels 94 and 94'. This drag band or belt 94 is formed at both sides or faces so as to be profiled or structured in its configuration, so that on the one hand, it cannot slip when in engagement with the deflection wheels 94 and 94' and, on the other hand, can be brought into engagement with entrainment cams or cam members 98 which are arranged at the links or brackets 22 or the like. The rotary bolt 92' is operatively connected by means of a chain-dot illustrated further chain drive 100, a deflection element or wheel 102 and a further chain drive 104 with the power take-off shaft 50 depicted in FIG. 2.

At the support elements 36'' and 36''' there are also secured the guides or guide members 24 and 26 and the rotation or rotary movement imparting cam or cam member 62. The guides or guide members 24 and 26, the mutual spacing N of which has reduced in the acceleration region or zone B, as will be seen by an inspection of FIG. 1, approach one another in the singling or separation region or zone C so as to form a single guide or guide member or structure 24, 26. Consequently, the links or brackets 22 of the buffer chain 20 are extended or stretched and the spacing between successive grippers or gripper elements 34 has increased to the largest possible extent. Consequently, the printed products 12 which are retained by the grippers or gripper elements 34 are singled or separated and at this region depend downwardly or hang at an inclination due to the inherent weight of such printed products 12.

A further deflection element or wheel 102' is rotatably mounted at the support element 36'''. This further deflection element 102' is operatively connected by means of a further chain drive 106 with the deflection element or wheel 102 mounted at the support element 36'' and is operatively connected by means of a chain drive 108 with the drive wheel 30 located in the product transfer region E, shown on an enlarged scale in FIG. 4.

Figure 4:
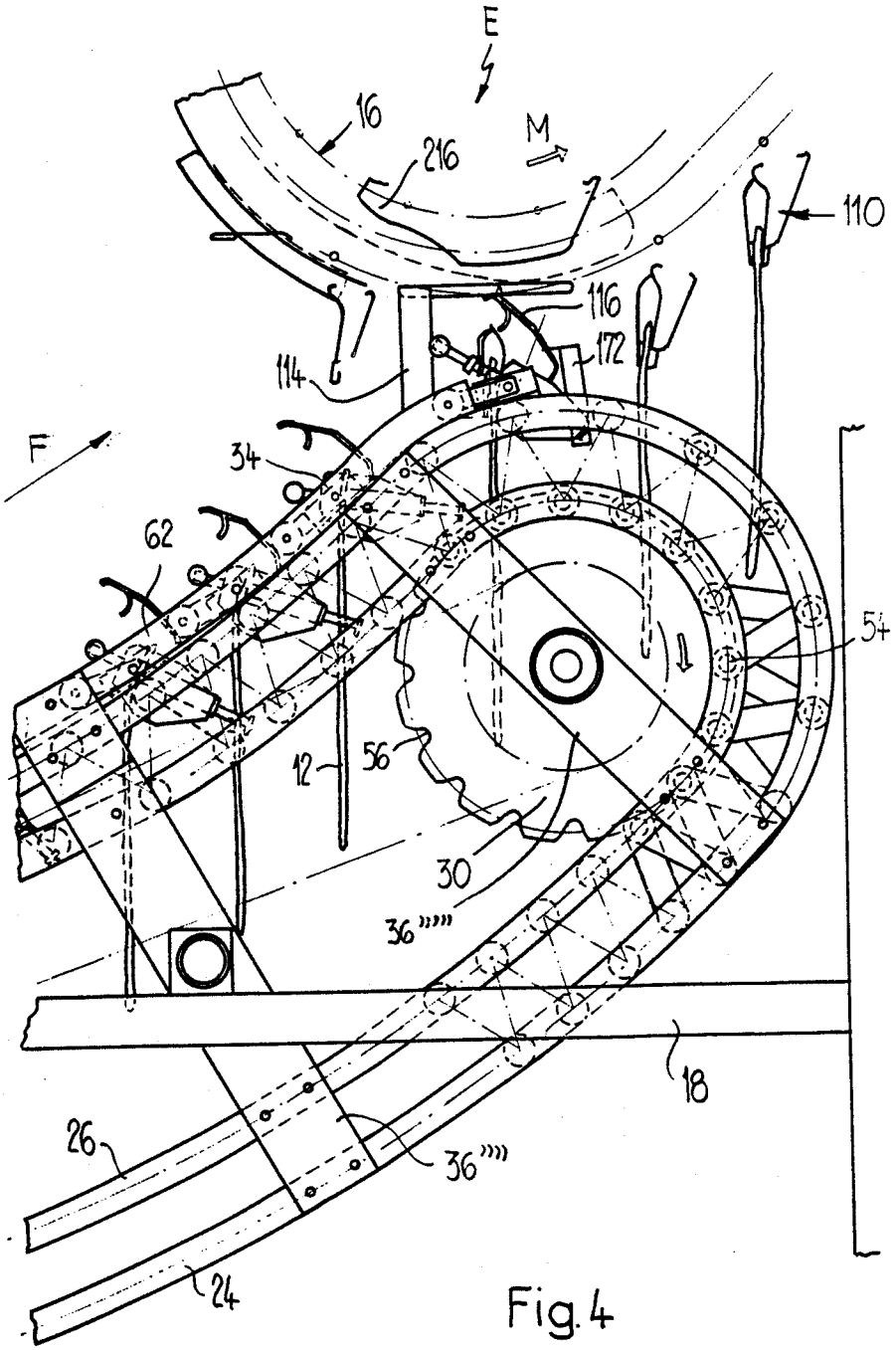
FIG. 4 illustrates on an enlarged scale, again like the showing of FIG. 2, the transfer region of the separation arrangement where the printed products are transferred from the separation arrangement to the outfeed or delivery conveyor.

Similar to the illustration of FIGS. 2 and 3 and what has been correspondingly explained in the related part of this disclosure, also in the portrayal of FIG. 4 the guides or guide members 24 and 26, the rotation cam 62 and the drive wheel 30 are secured at the related support elements 36'''' and 36''''. The guides or guide members 24 and 26 are also guided in this case, similar to the arrangement of FIG. 2, through a subtending arcuate region of approximately 180° concentrically with respect to the drive wheel 30. Also in this case, entrainment cut-outs or recesses or pockets 56 come into engagement with the pivot or hinge bolts 54 which are mounted in the second guide or guide member 26. The spacing between the rotation cam 62 and the guides or guide members 24 and 26 reduces in the product conveying or conveyance direction F, so that as will be explained more fully hereinafter the grippers or gripper elements 34 can be rotated or turned in relation to the guide or guide member 24. The grippers or gripper elements 34 are rotated to such an extent that the products are taken-over in a suspended posture by clamps or gripper fingers or elements 110 of the outfeed or delivery conveyor 16 or equivalent structure which moves in the direction of the arrow M. At the support element 36''''' there is arranged an opening cam or cam member 114 with which there come into contact clamping elements 116 of the grippers or gripper elements 34. The opening cam member 114 is here arranged such that it acts upon the clamping elements 116 as soon as the gripper or gripping fingers or finger members 110 of the outfeed conveyor 16 have engaged or seized the printed products 12 which have been brought into the depicted suspended posture or position. The rotation cam or cam member 62 extends up to the region of the opening cam member 114. At the return portion of the buffer chain 20 and the grippers 34 from the product transfer region E back to the product take-over region A there is not required any rotation cam or cam member 62.

Figure 5:
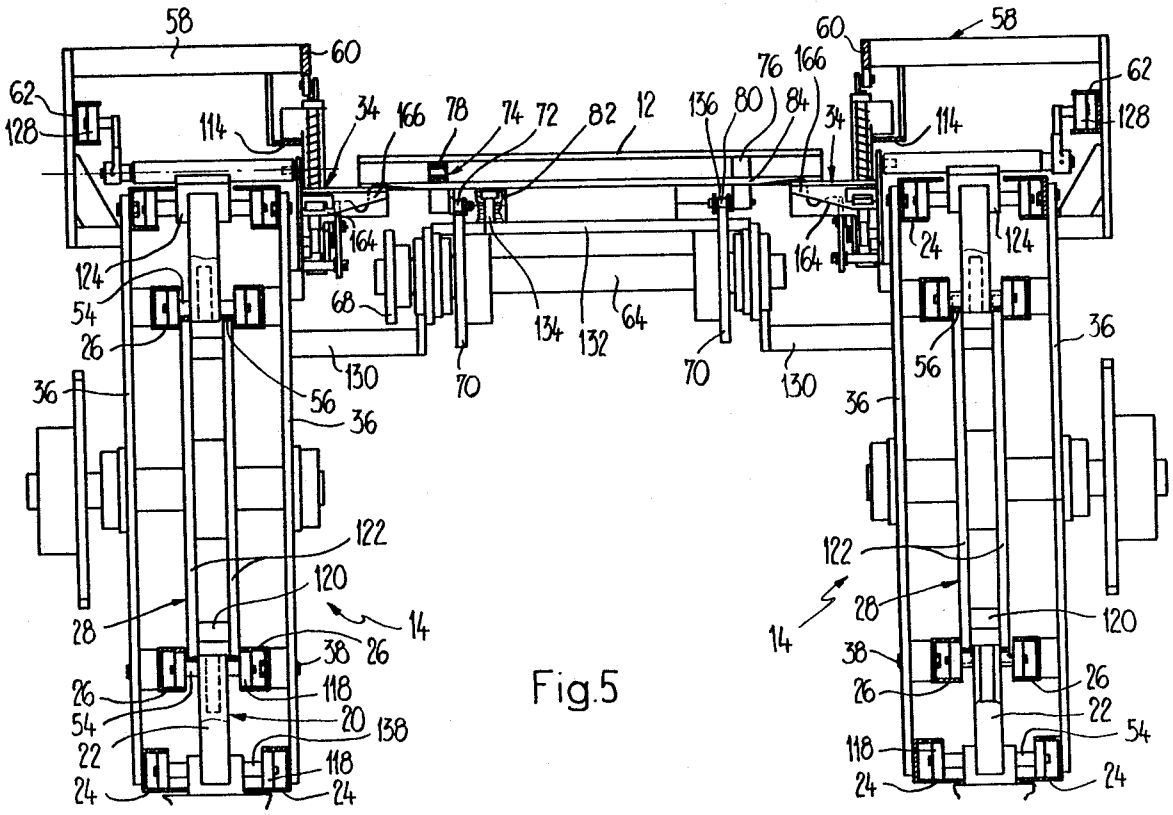
FIG. 5 is a partially sectional view of the separation arrangement depicted in FIG. 1, looking in the direction of the arrow F thereof.

In FIG. 5 there have been depicted two similarly constructed conveyor devices 14 with mirror-image arranged grippers or gripper elements 34. The conveyor devices 14 are shown partially in sectional view, and in particular the buffer chains 20 as well as the guides or guide members 24 and 26 at the region of the drive wheels 28 have been omitted. The first and second guides or guide members 24 and 26 which are secured by means of the threaded bolts 38 or the like, at the related support element 36 are arranged pairwise symmetrically with respect to the associated buffer chain 20. The guides or guide members 24 and 26 each comprise a C-shaped profile or structural member and such face, or are directed towards one another and in which there are guided the pivot bolts 54 by means of the guide rolls or wheels 118.

The drive wheel 28 comprises two co-revolving discs or disc members 122 which are spaced from one another by means of the spacer or distance members 120. The entrainment cut-outs or recesses or pockets 56 which are arranged at the disc members 122 act upon the pivot bolts 54 which are guided in the second guide members 26. The disc members 122 are spaced to such an extent from one another that the chain links or brackets 22 have adequate space therebetween. The first guide members 24 are spaced at a further distance from one another than the second guide members 26 as viewed in the direction from the pivot or hinge bolts 54. The same is also true for the guide wheel rolls or wheels 118 which are mounted at the corresponding pivot bolts 54. In the first guide members 24 there are guided bearing blocks 124. These bearing blocks 124 are operatively connected with the related buffer chain or chain member 20 by means of the pivot or hinge bolts 54, as will also be recognized by inspecting FIGS. 6 and 7. At the bearing blocks 124 there are pivotably mounted the grippers or gripper elements 34 about a pivot axis 126 (see FIG. 7) which extends substantially parallel to the pivot bolts 54. The grippers or gripper elements 34 will be described in greater detail hereinafter. At the cam support or carrier 58 there is secured the rotation cam or cam member 62 which likewise comprises, for instance, a C-shaped profile or structural element. Mounted in this rotation cam member 62 are the guide rolls or roller members 128 which act upon the grippers or gripper elements 34. At the cam support or carrier member 58 there are likewise arranged, as already previously described, the gripper closure member 60 and a gripper opening cam member 114, compare also to FIGS. 2 and 4.

The revolving cam system or cam means 66 is supported by the support or carrier members 130 at the associated support element 36. Likewise secured to the support or carrier member 130 are the chain guides or guide members 82 by means of the chain guide support or carrier members 132. The chain guide member 82 comprises two parts which are held together by means of a threaded bolt 134 and are secured at the chain guide support or carrier member 132. At the region of separation of both of these parts, there is arranged a guide groove 136 in which there is guided the conveying-active run 80 of the related endless chain 72 in a slightly concave formed path of movement, as also evident by referring to FIGS. 1 and 2. The cams or cam members or dogs 74 are arranged laterally offset at the associated endless chain or chain member 72. The cam or cam member or dog 74 depicted at the left half of the drawing of FIG. 5 is shown in sectional view, and the entrainment roll or roller member 78 comes to bear from below at the preceding or leading printed product 12. The right-hand positioned cam member 74 has not been shown in sectional view but it will be observed that the free end 76 also bears at the same printed product 12. The front edge 84 of the lower positioned printed product 12 bears at the rear end of both of the cam members 74.

The further components or parts which have not here been designated with reference characters in FIG. 5 have been generally already disclosed in the prior description relating to FIGS. 1 and 2.

Figure 6:
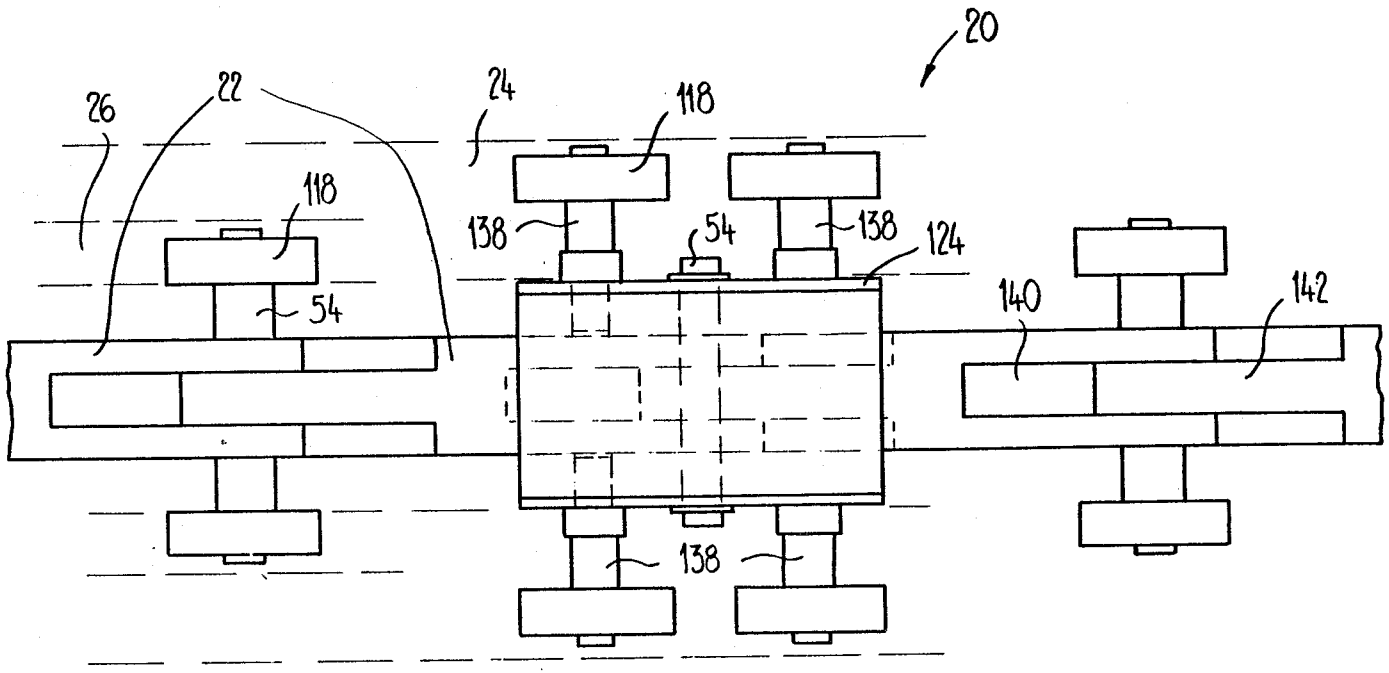
FIG. 6 is a top plan view of a portion of a buffer chain used in the apparatus of FIG. 1 and containing hingedly interconnected links or brackets or straps portrayed in their extended or stretched condition.

Turning attention now to FIG. 6, there has been illustrated on an enlarged scale a portion of the buffer chain or chain member 20. At the depicted bearing block 124 there are arranged pairs of laterally protruding stub shafts 138 at each of which there is rotatably mounted a respective guide roll or roller member 118. These guide rolls 118 are guided in the first guide or guide member 24 which has been shown in broken line. The associated pivot bolt or bolt member 54 pierces the side walls of the bearing block 124 which in section has a substantially C-shaped profile or configuration and in its central or intermediate region there are pivotably mounted two chain links or brackets or straps 22.

At each link or bracket 22 or the like, there is arranged at one end a link or bracket groove or groove member 140 and at the other end a projection or protuberance 142, or the like. The link groove or groove member 140 of a link or bracket 22 has such a width that the link or bracket projection or protuberance 142 of the neighboring link or bracket can be accommodated therein. At the overlapping region of a projection or protuberance 142 and a link or bracket groove 140 there is arranged in each case a pivot or hinge bolt or bolt member 54. The links or brackets 22 are guided at their one respective end in the second guides or guide members 26 and at the other respective end in the first guides or guide members 24 with or without bearing block 124. In FIG. 6 there has been illustrated in its extended or stretched condition or state a portion of the buffer chain or chain member 20, as such is the situation for the product singling or separation region C.

Figure 7:
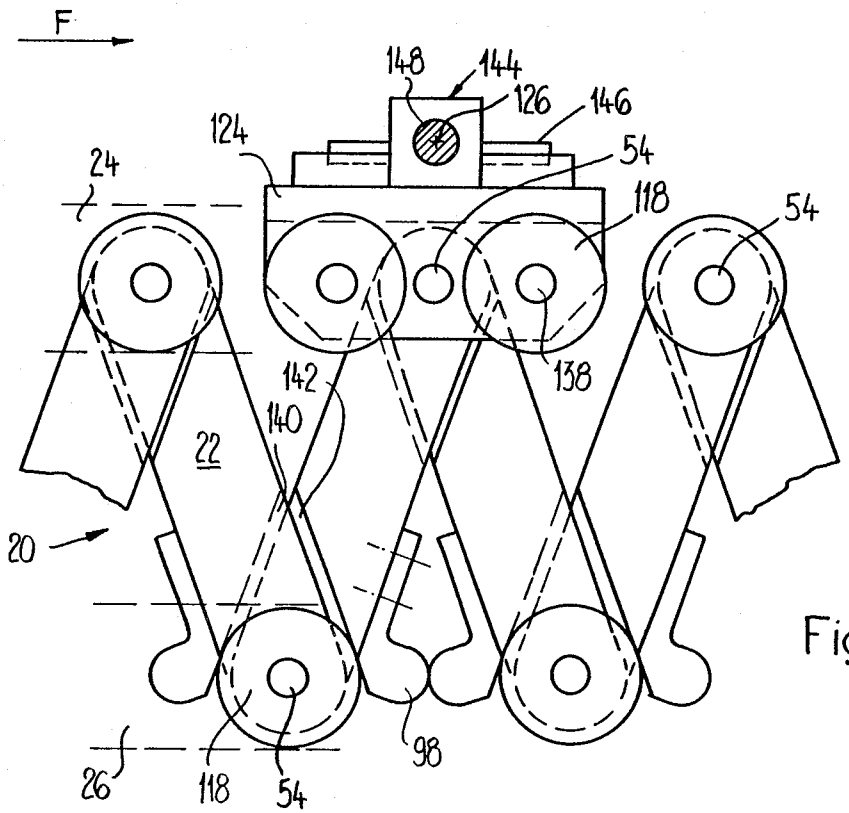
FIG. 7 is a side view of the buffer chain depicted in FIG. 6, wherein however, here there have been depicted the links or brackets or straps in their collapsed position wherein each two neighboring links or brackets or straps are rocked or pivoted so as to form a substantially V-shaped link or bracket or strap configuration.

On the other hand, in FIG. 7 the buffer chain or chain member 20 has been shown in its collapsed or folded together condition or state, as such for instance is the case in the product take-over region A, in the product transfer region E and in the return section extending from the product transfer region E back to the product take-over region A, as will be recognized by comparing FIG. 1. As to the components or parts which have already been described with reference to FIG. 6, the same will no longer be considered at this point. Each link groove 140 as well as the projection or protuberance engaging therein are constructed such that the spacing of two hinge or pivot bolts 54 which are guided in the same guide or guide member 24 or 26 can assume an exactly defined minimum spacing, but the guide wheels or rollers 118 never come to bear against one another, as such will be apparent by inspecting FIG. 7. The guides or guide members 24 and 26 have only been schematically shown in broken lines. At each link or bracket 22 there is secured an entrainment cam or dog 98 by means of threaded bolts which have been merely representatively depicted in chain-dot or phantom lines. At the region of the guide rolls or wheels 118 which are mounted in the second guides or guide members 26, these entrainment cams 98 extend approximately at right angles to the link lengthwise axis and protrude from the related link or bracket 22 in a plane disposed substantially perpendicular to the guide bolt or bolt member 54. In the position of the links or brackets 22 where they are pivoted or rocked towards one another, as the same has been depicted in FIG. 7, in each case two entrainment cams or cam members 98 of successive links or brackets 22 come to bear against one another, whereas when the buffer chain 20 is in its extended or stretched state these entrainment cams 98 protrude or extend approximately parallel to one another from the buffer chain 20, as also will be recognized by referring to FIG. 3.

Secured to the bearing block 124 is a bearing block projection or mount 144 at which there is arranged a stop or impact member 146. In the bearing block mount 144, there is pivotably mounted a pivot shaft 148 which defines the pivot axis 126, as thus seen by referring to FIG. 7. As already explained, this pivot axis 126 extends substantially parallel to the pivot bolts 54.

Figure 8:
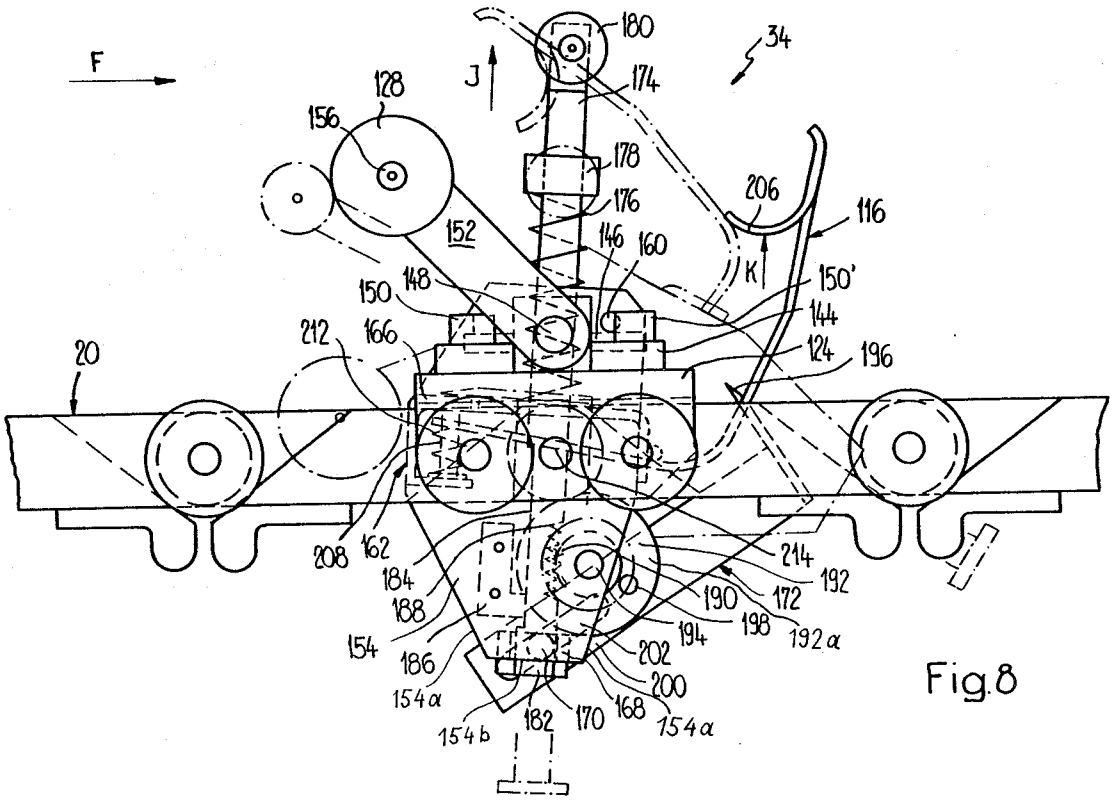
FIG. 8 is a side view of a gripper or gripper element which is operatively connected or associated with the buffer chain.
Figure 9:
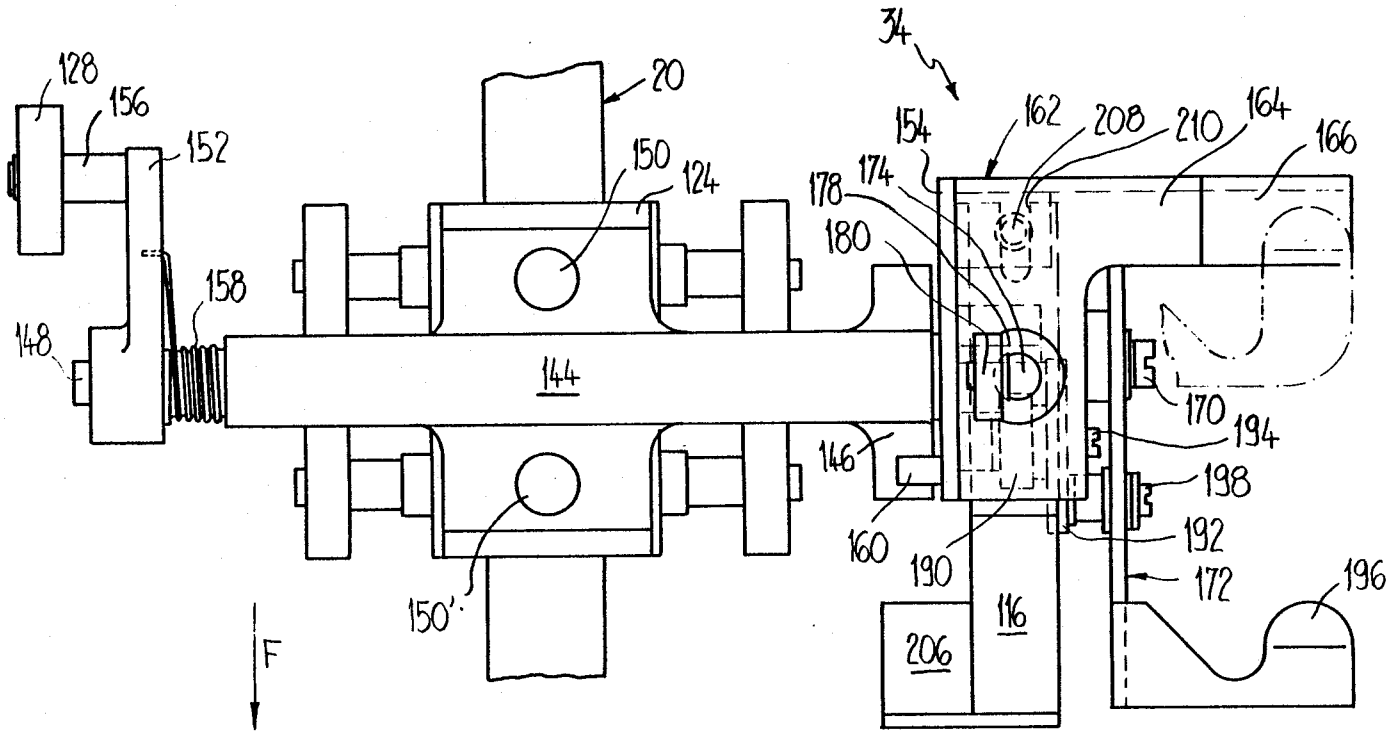
FIG. 9 is a top plan view of the gripper or gripper element depicted in FIG. 8.

Turning now to FIGS. 8 and 9 there has been illustrated on an enlarged scale one of the grippers or gripper elements 34. The bearing block projection or mount 144 is secured at the bearing block 124 by means of two threaded bolts or screws 150 and 150' or equivalent fastening expedients. At one end of a pivot shaft 148 there is arranged a pivot lever or lever member 152 and at the other end a support or carrier plate or plate member 154 and such parts 152 and 154 are rigidly connected for rotation or pivoting with the pivot shaft 148. At the free end of the pivot lever 152, there is rotatably mounted the associated guide roll or roller member 128 by means of a bolt stub portion 156. A torsion or rotary spring 158 or the like, is arranged about the pivot shaft 148 between the bearing block projection 144 and the pivot lever 152. One end of the torsion spring 158 bears at the pivot lever 152 and the other end thereof at the bearing block projection or mount 144. This torsion spring 158 is pre-biased and is effective in a direction such that the pivot lever 152 is loaded in the clockwise direction or sense, as will be evident by comparing FIG. 8. An impact bolt or bolt member 160 is connected with the support or carrier plate 154. This impact or stop bolt 160, in the normal position of the related gripper or gripper element 34, is brought to bear at the stop or impact member 146 by the action of the torsion spring 158. Since the stop or impact member 146 protrudes at both sides from the bearing block projection or mount 144, the support or carrier plate 154 can only be pivoted through an angle of about 180° in the counter-clockwise direction in relation to the position depicted in FIG. 8. In the rest position the posture or position of the support or carrier plate 154 and thus the pivot lever 152 is exactly defined by the force of the torsion spring 158, the stop or impact bolt 160 and the stop or impact member 146. This position has been illustrated in FIG. 8 with full lines. What has been shown with chain-dot or phantom lines is a position which has been pivoted in counter-clockwise direction through an angle of about 70°.

The support or carrier plate 154 comprises an angled member, for instance a hexagonal member formed, for instance, of a sheet metal plate or plating having unequal legs or sides, the downwardly directed side edges or regions **154*a* of which intersect at an acute angle and are bounded by a lower edge or side 154*b* which extends approximately parallel to the extended buffer chain 20. This support or carrier plate 154 is located in a plane which is essentially perpendicular to the pivot shaft 148. A clamping jaw or jaw member 162 or equivalent clamping element is appropriately fixed, as by welding, to the support or carrier plate 154. This clamping jaw 162 is formed, for instance, from a substantially C-shaped bent sheet metal plate or plating which is downwardly open and at which there is formed a clamping jaw projection 164 at the trailing end viewed with respect to the product conveying or conveyance direction F. From the illustration of FIG. 5, it will be particularly apparent that the clamping jaw projection 164 extends to the region of the printed products 12 of the imbricated formation or stream S and at that location, such clamping jaw projection 164 is provided with a jaw support 166**.

A guide plate or plate member 168 is arranged at the lower end of the support or carrier plate 154. At such guide plate 168, there is secured a pivot bolt or bolt member 170 about whose lengthwise axis there is pivotably mounted a clamping element shown here as a clamping finger or finger member 172.

A plunger or plunger member 174 is slidingly guided for movement approximately transverse to the product conveying direction F in the clamping jaw or jaw member 162 and in the guide plate 168. A compression or pressure spring 176 is arranged about the plunger or plunger member 174. This compression spring 176 bears at one end at the clamping jaw 162 and at the other end thereof at a plunger collar or shoulder 178 attached to the plunger or plunger member 174. At the upper end of the plunger 174 there is rotatably mounted thereat a cam follower roll 180 or equivalent structure. An impact or stop disc 182 is attached to the lower end of the plunger 174. This impact or stop disc or disc member 182 bears against the guide plate or plate member 168 and prevents movement of the plunger 174 in the direction of the arrow J (see FIG. 8). Milled or otherwise appropriately formed at the plunger 174 is a slide portion or plane 184 which is mounted at a slide shoe or shoe member 186. This slide shoe 186 consists of, for instance, a suitable plastics material and is attached by means of threaded bolts or screws or the like at the support or carrier plate 154. The slide shoe 186 prevents rotation of the plunger 174 about its lengthwise axis. A tooth portion or teeth means 188 are arranged opposite the slide portion or plane 184 at the plunger 174. The tooth portion or teeth means 188 coact with a pinion 190. Rigidly connected for rotation with the pinion 190 is a crank or crank member 192 in the form of a disc 192a. The pinion 190 and the crank 192 are rotatably mounted at a shaft or shaft member 194 which is arranged at the support or carrier plate 154.

The end region of the clamping finger 172 located remote from the pivot bolt 170 is flexed or bent and forms a clamping finger jaw 196. At the intermediate or central region this clamping finger 172 is rotatably mounted at the crank 192 by means of a shaft 198. Hence, the clamping finger or finger member 172 forms a connecting rod 200 of a crank drive whose crank slot 202, constructed as an elongate hole, is mounted at the pivot bolt 170.

At the downwardly bent part of the clamping jaw 162, and which leads as viewed in the product conveying direction F, there is pivotably mounted the gripper clamping or locking element 116. A slide arcuate portion or curved member 206 is formed at one end of the clamping or locking element 116 and at the other end this clamping element 116 is slidably mounted at a guide bolt or bolt member 208 arranged at the clamping jaw or jaw member 162. For this purpose, the clamping or locking element 116 is provided at that end with a cut-out or recess 210, the side edges of which slide at the guide bolt 208 (see FIG. 9). A compression or pressure spring 212 is supported at the clamping jaw 162 and is arranged about the guide bolt 208. This compression or pressure spring 212 acts upon the clamping or locking element 116 at the region of the cut-out or recess 210.

The plunger or plunger member 174 penetrates or pierces through the clamping or locking element 116 at a clamping opening or aperture 214.

The operation or function of the depicted gripper or gripper element 34 will now be described in conjunction with FIGS. 8 and 9. The gripper or gripper element 34 is depicted in these FIGS. 8 and 9 in an open position, and a closed position thereof has been indicated with chain-dot or phantom lines. The diameter of the clamping opening 214 is only slightly larger than the diameter of the plunger or plunger member 174. Due to the pivoting of the clamping or locking element 116 in the clockwise direction by virtue of the exerted force of the compression or pressure spring 212, the edge of the clamping opening 214 bears at the plunger 174 so that this plunger 174 is clamped or locked in its depicted position. Due to the action of a force in the direction of the arrow K (see FIG. 8) the clamping element 116 is pivoted or rocked against the force of the compression or pressure spring 212 in the counter-clockwise direction. The clamping opening or aperture 214 now releases the plunger 174. By applying a force upon the cam follower roll or cam follower 118 opposite to the direction of the arrow J, the plunger 174 slides or moves against the force of the compression spring 176 downwardly until assuming the chain-dot or phantom line depicted position. The tooth portion or teeth means 188 cause rotation of the pinion 190 and thus the crank or crank member 192 in the counter-clockwise direction. The clamping finger jaw 196 moves through a path of travel opposite to the product conveying direction F and in an upward direction. An apex or zenith of this path of travel is located above a path of travel of the jaw support 166. After reaching this apex or zenith the path of travel of the clamping finger jaw 196 now extends further contra or in opposition to the product conveying direction F and downwardly towards the jaw support 166. Upon releasing the clamping or locking element 116, the latter moves, under the action of the compression spring 212, in the clockwise direction until the edge of the clamping opening 214 again bears at the plunger or plunger member 174 and lockingly retains such in the closed position.

As already explained previously, in order to shift the clamping finger 172 into the open position the clamping or locking element 116 is again moved in the counter-clockwise direction. Under the force of the compression or pressure spring 176, the plunger 174 moves out of the chain-dot depicted position in the direction of the arrow J until the impact or stop disc 182 abuts against the guide plate 168, so as to return back into the original plunger position. As a result, the crank 192 is driven in the clockwise direction and the clamping finger jaw 196 moves along the same path of travel however now in the product conveying direction F back into the open position.

Based upon the illustration of FIG. 1, there will now be more fully explained the herein disclosed exemplary embodiment of apparatus for processing substantially flat or superficial products, especially printed products. A single printed product 12 is continually accompanied from the region of the infeed device 10 up to the outfeed or delivery conveyor 16. At the product take-over region or zone A the entrainment roll or roller member 78 of a cam or cam member or dog 74 of the revolving cam or dog system 66 comes to bear initially from below at the intermediate or central region of the associated printed product 12. The velocity of the revolving motion of the endless chain or chain member 72 is of the same magnitude or smaller than the product conveying velocity of the infeed device 10. However, since the cam or dog 74 or the like, during its deflection or turning about the guide wheel or wheel member 70, moves through a greater path than the endless chain 72 itself, the printed product 12 is pushed by the entrainment roll 78 against the preceding cam or dog 74 until its front product edge 84 abuts thereat, as evident from the illustration of FIG. 2. As will be apparent from the illustration of FIG. 5, since two revolving cam or dog systems 66 are arranged in mutual parallelism and spaced relationship and thus two cams or dogs 74 simultaneously act upon the printed product 12, this printed product 12 is aligned and brought into an exact spacing with respect to the preceding or leading printed product 12, this spacing corresponding to the spacing of in each case two successive cams or dogs 74. As soon as the conveying-active run 80 of the endless chain 72 moves off the guide wheel 70 the free end 76 of each such cam or dog 74 also comes into contact with the printed product 12. In this position, where in each case the front product edge 84 is freed or exposed by lifting the preceding or leading printed product 12, the printed products are further conveyed by the revolving cam or dog system 66 in the product conveying or conveyance direction F.

The drive wheel or wheel member 28 moves in the direction of the arrow L. The buffer chain 20 is folded at the product take-over region or zone A so that a short spacing is present between the grippers or gripper elements 34. The entrainment cut-outs or recesses 56 transmit the rotational movement of the drive wheel 28 to the pivot bolts 54 of the buffer chain 20, with the result that at the curved portion of the guides or guide members 24 and 26 there is slightly increased the spacing of the pivot or hinge bolts 54 which are mounted in the first guide or guide member 24. However, this spacing is again reduced and balanced out as soon as the buffer chain 20 departs from the region of the drive wheel 28. Between two grippers or gripper elements 34 there are arranged in each instance four links or brackets 22. The spacing of these grippers 34, viewed in the direction of revolving motion of the buffer chain 20, and upon departing from the drive wheel 28 is exactly equal in size to the spacing of two successive cams 74 of the revolving cam system 66.

The grippers or gripper elements 34 reach the product take-over region or zone A in an open position, and thus, the jaw support 166 comes to bear from below at the printed product 12 at the region of the front edge 84 of such printed product 12. At the same time, the guide roll 128 arrives at the widened inlet portion of the rotation cam 62, indicated by position I in FIG. 2. The slide or sliding arcuate portion 206 of the clamping or locking element 116 travels upon the related gripper opening cam 114, see FIG. 5, and is released thereby. The cam follower roll 180 comes to bear at the closing cam or cam member 60. The spacing between the guide or guide member 24 and the closing cam 60 is reduced in the product conveying direction F. Consequently, the plunger 174 of the gripper or gripper element 34 is pressed downwardly essentially perpendicular to the product conveying direction F, resulting in the closing motion of the clamping finger 172. The printed product 12 is thus positively clamped between the jaw support 166 and the clamping finger jaw 196, as indicated by position II in FIG. 2. The clamping or locking element 116 is then released by the opening cam 114, so that the plunger 174 is now fixedly clamped in the closed position thereof and the cam follower roll 180 can run off of the closing cam 60 without shifting the clamping finger 172 into the open position. The rotation cam 62 is guided substantially parallel to the guide or guide member 24 so that there is maintained the pivoted position of the gripper or gripper element 34 in relation to the guide or guide member 24. The cam or cam member 74 has reached the region of the guide wheel 70' and now moves away from the printed product 12.

As will be particularly evident by referring to FIG. 1, at the product acceleration region or zone B there is reduced the spacing or distance N between the guides or guide members 24 and 26. As a result, at this acceleration region or zone B the buffer chain 20 is extended or stretched and there is enlarged the spacing between the grippers 34. As soon as the spacing between two grippers 34 is sufficiently large, then the preceding or leading printed product 12 is released from the trailing printed product 12 and drops into an inclined rearwardly directed suspended position. Towards the end of the acceleration region or zone B, both of the guides or guide members 24 and 26 again merge with one another, so that the buffer chain 20 is totally extended or stretched at this region and the grippers or gripper elements 34 assume a maximum spacing from one another.

At the subsequent product singling or separation region C the drag or tow drive 32 comes into operative connection or association with the entrainment cams or dogs 98 of the chain links or bracket 22, as will be recognized by referring to FIG. 3. The revolving velocity of the drag drive 32 is greater than the circumferential velocity of the drive wheel 28. Hence, the drag drive 32 exerts a tensile force or load upon the buffer chain 20, rendering possible a faultless shifting or transformation of the same into the extended or stretched position.

However, the drag or tow drive 32 also exerts a compressive force upon the further conveyed chain links or brackets 22 as viewed in the product conveying or conveyance direction F, so that there is rendered possible the collapsing of the buffer chain or chain member 20 at the product deceleration region D. At this deceleration region D both of the guides or guide members 24 and 26 again move apart, so that the spacing between the grippers 34 is reduced until towards the end of the deceleration region or zone D the mutual spacing of the grippers or gripper elements 34 again assumes a minimum value. At this region the rotation cam or cam member 62 slowly approaches or nears the first guide or guide member 24, resulting in a rotation of the grippers or gripper elements 34 in the clockwise direction. The printed products 12 are thus transferred in an extended suspended posture or position.

At the product transfer region or zone E the product conveying direction F is directed from the bottom towards the top and the front edges 84 of the printed products 12, which are upwardly freely exposed or freed, are introduced into the open gripper fingers or clamps 110 of the outfeed or delivery conveyor 116. The conveying velocity of the outfeed or delivery conveyor 116 is of the same magnitude as the velocity of the pivot or hinge bolts 54 in the second guide or guide member 26 at the transfer region or zone E. However, since the grippers or gripper elements 34 exhibit a greater velocity at the curved section about the drive wheel or wheel member 30, the printed product 12 is introduced towards the leading gripper or gripping finger or clamp 110, as will be evident from the illustration of FIG. 4. The gripper finger or clamp 110 is closed by the action of a further closing cam or cam member 216 and the front edge 84 of the related printed product 12 is fixedly held therein. The clamping or locking element 116 impacts against the associated opening cam or cam member 114, with the result that it is moved in counter-clockwise direction. This, in turn, releases the plunger 174 and causes the therewith associated opening movement of the clamping finger or finger member 172. The opened grippers or gripper elements 34 are now turned or deflected about the drive wheel or wheel member 30 in conjunction with the folded buffer chain 20 and thus arrive back at the drive wheel 28 at the product take-over region A.

The conveyor device or arrangement 14 need not be constructed in the depicted banana-shaped or arcuate configuration. Thus, it is quite conceivable and within the teachings and scope of the present invention that the guides or guide members 24 and 26 extend linearly between the drive wheels or wheel members 28 and 30. The banana-shape or arcuate form of the conveyor device or arrangement has the advantages that the space requirements are relatively small, that by virtue of the curvature of the guides or guide members 24 and 26 at the take-over region A and the transfer region E there can be realized desired relative velocities between the infeed device 10 and the grippers 34 and between the grippers 34 and the gripper fingers 110, respectively, and that above all in the deceleration region or zone D, owing to the centrifugal forces, the corresponding pivot or hinge bolts or bolt members 54 can enter the second guide or guide member 28 without any problem.

While there are shown and described present preferred embodiments of the invention, it is to be distinctly understood that the invention is not limited thereto, but may be otherwise variously embodied and practiced within the scope of the following claims.

According, What I claim is:

1. A method of processing substantially flat products, especially folded printed products, arriving in an imbricated formation, comprising the steps of:

infeeding the products in an imbricated formation such that leading regions of the infed products have a predetermined mutual spacing and each product bears upon a trailing printed product as viewed in a predeterminate direction of conveying of the products along a predeterminate conveying path;

individually engaging the products at their leading regions by means of grippers successively arranged at a mutual spacing substantially equal to said predetermined mutual spacing between the leading regions of the infed products in the predeterminate direction of conveying of the products and moved along the predeterminate conveying path; and thereafter increasing the spacing between each two successive grippers to such an extent that each product is brought into non-overlapping separated relationship with respect to the trailing product.

2. The method as defined in claim 1, further including the step of:

again decreasing the spacing between the grippers following separation of each two successive products while maintaining the non-overlapping relationship between said each two successive products.

3. The method as defined in claim 2, further including the step of:

placing said each two successive products in a suspended non-overlapping posture after separation of each two successive products.

4. The method as defined in claim 1, further including the step of:

after said step of increasing the spacing between each two successive grippers placing each two successive products in a suspended posture and maintaining said non-overlapping separated relationship of each product with respect to the trailing product.

5. An apparatus for processing substantially flat products, especially folded printed products, comprising:

an infeed device for infeed of the products in an imbricated formation in a predeterminate direction of movement;

said infeed device infeeding the products in an imbricated formation such that each product overlappingly bears upon a trailing product with respect to the predeterminate direction of movement of the products;

said infeed device infeeding said products such that said products in said infed imbricated formation possess leading regions arranged at a predetermined mutual spacing as viewed in said predeterminate direction of movement of the products;

means for separating the overlapping products from one another;

said separating means comprising:

conveyor means arranged following the infeed device;

said conveyor means comprising at least one revolvingly driven traction element;

individually controllable grippers mounted at said at least one revolvingly driven traction element at a mutual spacing substantially equal to said predetermined mutual spacing between said leading regions of the products in said infed imbricated formation;

each of said individually controllable grippers serving for seizing an associated one of the infed products at a leading product region; and means for increasing the spacing between each two successive grippers after seizing of a printed product by at least one of said two successive grippers in order to thereby place each two successive products into a non-overlapping separated relationship.

6. The apparatus as defined in claim 5, further including:

guide means for guiding said at least one revolvingly driven traction element; and said at least one revolvingly driven traction element comprises a buffer chain provided with hingedly interconnected links.

7. The apparatus as defined in claim 6, wherein:

said guide means contain said spacing increasing means comprising a first guide means and a second guide means;

said hingedly interconnected links containing pivot bolts for hingedly interconnecting said links;

said pivot bolts of said hingedly interconnected links being guided at said first and second guide means;

said conveyor means moving the products in a predeterminate direction of conveyance;

said separating means including an acceleration region; and the spacing between the first and second guide means decreasing at the acceleration region in a direction substantially perpendicular to said pivot bolts and with respect to said predeterminate direction of conveyance of the products.

8. The apparatus as defined in claim 7, wherein: said pivot bolts are alternately guided at opposite ends thereof by the first and second guide means.

9. The apparatus as defined in claim 7, further including:

bearing block means;

each gripper being arranged at an associated bearing block means;

said bearing block means being guided at said first guide means; and said bearing block means being operatively connected by predeterminate ones of said pivot bolts with said buffer chain.

10. The apparatus as defined in claim 5, wherein:

said separating means comprises a product take-over region where the products are transferred from the infeed device to the conveyor means;

a product alignment device arranged at said product take-over region;

said product alignment device comprising conveyor element means;

cam means arranged at a predeterminate fixed spacing from one another at said conveyor element means; and said cam means acting from below upon the products and on said leading regions of the products for conveying said products at said predetermined mutual spacing between said leading regions of said products in said infed imbricated formation.

11. The apparatus as defined in claim 10, wherein:

said conveyor element means of said product alignment device comprise two substantially parallel revolving conveyor elements.

12. The apparatus as defined in claim 6, wherein:

said separating means comprises a product separating region;

said individually controllable grippers possessing a maximum mutual spacing from one another at said product separating region;

a drag drive arranged at said product separating region; and said drag drive acting upon said hingedly interconnected links.

13. The apparatus as defined in claim 7, wherein:

said separating means comprises a product separating region;

said grippers possessing a maximum mutual spacing from one another at said product separating region;

a drag drive arranged at said product separating region;

said drag drive acting upon said hingedly interconnected links;

a product deceleration region arranged following the separation region; and said first and second guide means possessing an increased spacing from one another at said product deceleration region.

14. The apparatus as defined in claim 9, further including:

pivot shafts extending substantially parallel to said pivot bolts;

means for pivotably mounting the individually controllable grippers at the bearing block means about said pivot shafts extending substantially parallel to said pivot bolts;

said separating means including a product transfer region;

an outfeed conveyor provided for said product transfer region;

the products being transferred by the conveyor means to said outfeed conveyor at said product transfer region;

rotation cam means provided at least at said product transfer region for pivoting the individually controllable grippers in order to thereby produce a suspended non-overlapping posture after separation of said each two successive products;

opening cam means provided at said product transfer region; and said opening cam means opening the individually controllable grippers.

15. The apparatus as defined in claim 14, wherein:

said separating means comprises a product take-over region where the products are transferred from the infeed device to the conveyor means;

a product alignment device arranged at said product take-over region;

said product alignment device comprising conveyor element means;

cam means arranged at a predeterminate fixed spacing from one another at said conveyor element means;

said cam means acting from below upon the products;

said separating means comprising a product separating region;

said individually controllable grippers possessing a maximum mutual spacing from one another at said product separating region;

a drag drive arranged at said product separating region;

said drag drive acting upon said hingedly interconnected links;

the first and second guide means extending at an inclination downwardly at the product take-over region in the predeterminate direction of conveyance of the products;

said first and second guide means extending approximately horizontally at the product separation region; and said first and second guide means extending at an inclination upwardly at the product transfer region with respect to the predeterminate direction of conveyance of the products.

16. The apparatus as defined in claim 14, further including:

spring means for retaining the individually controllable grippers in a rest position with respect to the bearing block means.

17. The apparatus as defined in claim 7, wherein:

said separating means comprises a product take-over region and a product transfer region;

drive wheel means arranged at said product take-over region and at said transfer region; and said drive wheel means acting upon the pivot bolts hingedly interconnecting the hingedly interconnected links of said buffer chain and guided in the second guide means at the region of the product take-over region and at the product transfer region.

18. The apparatus as defined in claim 5, further including:

at least two of said revolvingly driven traction elements and defining synchronously revolving substantially parallel and mutually spaced traction elements; and said individually controllable grippers being mounted at each one of said at least two revolvingly driven traction elements and the individually controllable grippers of different ones of said at least two revolvingly driven traction elements being mounted separately from each other with respect to said different traction elements.

* * * * *

UNITED STATES PATENT AND TRADEMARK OFFICE

CERTIFICATE OF CORRECTION

PATENT NO. : 4,895,360

DATED : January 23, 1990

INVENTOR(S) : Walter Reist

It is certified that error appears in the above-identified patent and that said Letters Patent is hereby corrected as shown below:

Column 5, line 29, before "outfeed" insert -- or delivery conveyor 16 or equivalent structure. This --.

Column 5, line 40, after "only" insert -- been --.

Column 7, lines 19-20, after "rearwardly" insert -- flexed or bent as viewed in the direction of revolving motion of --.

In the Claims

Column 20, line 23, after "said" insert -- product --.

Signed and Sealed this

Ninth Day of April, 1991

*Attest:*

*Attesting Officer*

HARRY F. MANBECK, JR.

*Commissioner of Patents and Trademarks*